United States Patent [19]

Stoll

[11] Patent Number: 4,590,846

[45] Date of Patent: May 27, 1986

[54] PISTON AND CYLINDER ACTUATOR

[76] Inventor: Kurt Stoll, Lenzhalde 72, 7300 Esslingen, Fed. Rep. of Germany

[21] Appl. No.: 709,444

[22] Filed: Mar. 8, 1985

[30] Foreign Application Priority Data

Mar. 9, 1984 [DE] Fed. Rep. of Germany ..... 3408607

[51] Int. Cl.[4] ..... F01B 7/16

[52] U.S. Cl. ..... 92/151

[58] Field of Search ..... 92/151, 152

[56] References Cited

U.S. PATENT DOCUMENTS

| | | | |
|---|---|---|---|
| 1,031,528 | 7/1912 | Cole | 92/151 |
| 3,288,036 | 11/1966 | Fisher | 92/151 |
| 3,485,141 | 12/1969 | Ott et al. | 92/151 |
| 3,554,088 | 1/1971 | Bruyn | 92/151 |
| 4,017,236 | 4/1977 | Penkman et al. | 92/151 |
| 4,141,220 | 2/1979 | Feucht | 92/151 |

*Primary Examiner*—Robert E. Garrett
*Assistant Examiner*—Mark Williamson
*Attorney, Agent, or Firm*—McGlew and Tuttle

[57] ABSTRACT

A piston and cylinder actuator is of modular construction and is made of axially aligned actuator cells or units that are able to be joined together end to end and each comprise a cylindrical wall with end walls, a piston and a piston rod. In the case of all single cells, with the possible exception of the cell at the end opposite to the end at which the piston rod is to act on a load, the piston rod projects out from the two sides of the piston and the end walls each have an opening for the piston rod ends so that in the assembled condition of the actuator the piston rods of the individual cells abut each other where the end faces of the cells adjoin each other. The piston driving spaces that in all cases are on the same side of the each piston, may be supplied with driving fluid in parallel by way of ducts running from one end of the actuator to the other and made up of holes in the cylindrical walls of the cells. The connection hole of one of the cells has an outwardly opening port for the supply of driving fluid from an outside connection line. The connection holes of all the cells end at identical position of the end walls of the cells for connection together when the cells are put together.

20 Claims, 3 Drawing Figures

PISTON AND CYLINDER ACTUATOR

BACKGROUND OF THE INVENTION

The present invention relates to piston-cylinder actuators, more specially for compressed air operation, having a cylinder structure that is closed at ends thereof, a piston unit able to be reciprocated in the cylinder structure when being acted upon by fluid under pressure, and a central piston rod adapted to be moved out of the cylinder structure to some degree when the actuator performs a working stroke.

Such actuators are used for for a wide range of different purposes in engineering when work has to be performed using a reciprocating piston rod. Dependent on the force to be exerted by the actuator, a variety of different actuators is available with different piston working areas and therefore different overall dimensions. Therefore the producers of such actuators have to manufacture them with different sizes in order to meet current market needs. The need to offer such a variety of different actuators does however necessitate a considerable manufacturing capacity and large stockholding facilities. Furthermore, it is a drawback for the customer that a given actuator is only available with a certain unalterable design and therefore only suitable for limited applications.

SHORT SUMMARY OF THE PRESENT INVENTION

Therefore one purpose or object of the present invention is to design a piston and cylinder actuator of the simplest possible form that yet may be adapted to different applications with the least possible assembly work.

In order to effect this and other purposes in keeping with the invention, the actuator is composed of a number of axially aligned modular cylinder cells adapted to be joined together at ends thereof, each such cylinder cell having an end wall, a piston and a piston rod, the piston rod of each such unit projecting from the two sides of each piston into holes in opposite end cylinder walls to such an extent that, when the cells are assembled end to end, ends of said cells abut each other, said cylinder cells having cylindrical walls with connection holes therein having ports opening into piston driving spaces in the said cells such that through such connection holes in the walls driving spaces on one side of each said piston are ganged in parallel together so that they may be supplied in common with driving fluid, the connection hole in one cell having a port for connection with an external supply line.

It will be seen from this that it is a question of individual units that may be coupled together in any desired number so that the pressure forces acting on the separate pistons are summated, by way of the abutting piston ends, each one piston rod pushing the rod in front of it along in the direction of action. However the cells may also be used individually, viz., not in conjunction with other cells, so that a variety of applications is opened up. In all cases it is possible for a suitable actuator to be customized for a particular application without being oversize, as has often been the case in the prior art, that is to say with an excessive length and an excessive consumption of driving fluid such as air.

It is a relatively simple matter to join the modular cells together so that the amount of assembly work needed is not large.

Moreover, since the supply and discharge of driving fluid is via a single port leading to the outside and the other cells, when assembled together, are joined with such port, the amount of supply line or hose and the complexity thereof is not greater than with conventional actuators.

An account will now be given of convenient working examples of the invention with reference to the accompanying drawings.

LIST OF THE DIFFERENT VIEWS OF THE FIGURES

DETAILED ACCOUNT OF WORKING EXAMPLES OF THE INVENTION

Figure 1:
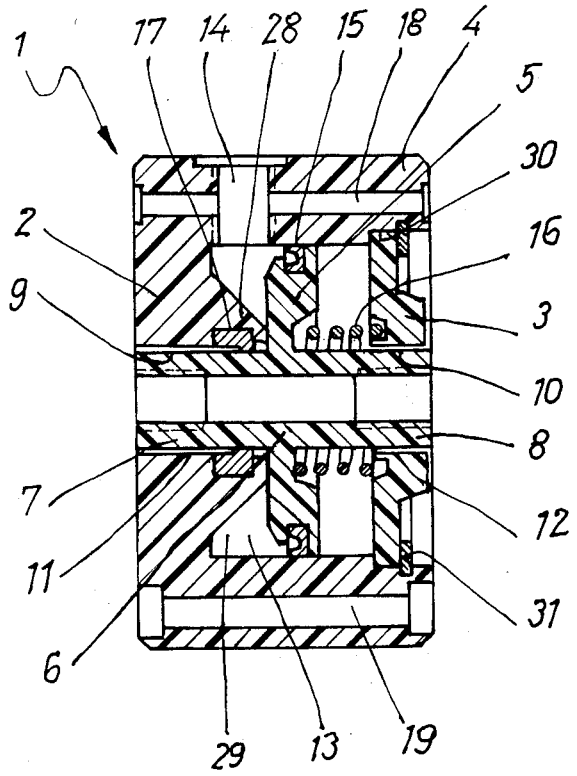
FIG. 1 is a longitudinal section through a modular cell in accordance with the present invention.

FIG. 1 shows a single modular cell 1 with a piston and cylinder that is adapted for compressed air operation. The cell or unit has a cylinder 4 with radial end walls 2 and 3, a piston 5 adapted to run axially backwards and forwards in the cylinder 4, and a piston rod 6 running out from the two sides of the piston 5. The end parts 7 and 8 of the piston rod 6 run in holes 9 and 10 in the end walls 2 and 3 respectively of the cell so that the piston rod is supported at its two ends and the end faces are exposed. There are bearing bushes 11 and 12 in the holes 9 and 10 respectively.

In this form of the invention the piston 5 is single acting and the piston driving space 13 is between the piston 5 and the end wall 2. The driving fluid in the form of compressed air is supplied to this space. Such supply of fluid is by way of a radial connection hole 14, opening into the working or driving space 13, in the cylinder wall and running from an open connection port. This connection port may be connected with an exterior connection line that is not shown. A three-way valve, also not shown, controls the supply and discharge of fluid from the exterior connection hole 14. If driving fluid is supplied to the piston driving space 13, the piston 5, that has a peripheral lip packing 15 sealing on the cylinder bore, will be moved to the right in terms of the figure away from the end wall 2 so that the piston end part 8 will move outwards from the end wall during its working stroke. A return spring 16 acts on the side of the piston 5 opposite to the piston driving space 13, the other end of the spring 16 resting against the adjacent cylinder end wall 3. The spring 16 moves the piston (and with it the piston rod 6 on which it is mounted) back as soon as the three-way valve is switched over from forward motion to retraction stroke.

In this instance of a single acting piston it is only necessary for the piston driving space 13 to be sealed off from the outside so that it is only in the piston rod hole 9 that there is only a packing ring 17 for sealing the piston rod end part 7.

Furthermore an axial connection hole 18 is machined in the wall of the cylinder 4 to provide a junction with the connection hole 14 by intersecting it. The connection hole 18 is aligned axially and runs from one end of the cell to the other.

The cylinder wall of the single cell 1 furthermore has a set of axial assembly and mounting holes 19 running through it that are distributed around the axis of the cell. In the figure one of such holes will be seen but in all there are more of them, as for example four. The purpose of these holes and of the connection hole 18 will be explained later on.

The individual cell 1 may be used for all those applications wherein the force produced by the action of the fluid on one side of the piston 5 is sufficient to perform the amount of work needed by way of the piston rod 6. To prepare the cell for such use by itself and without other units, it is only necessary for the two outer ports of the connection hole 18 to be sealed off, as for example by way of a plug or the like. The single cell 1 may however also be employed as a module to build up a larger piston and cylinder actuator.

Figure 2:
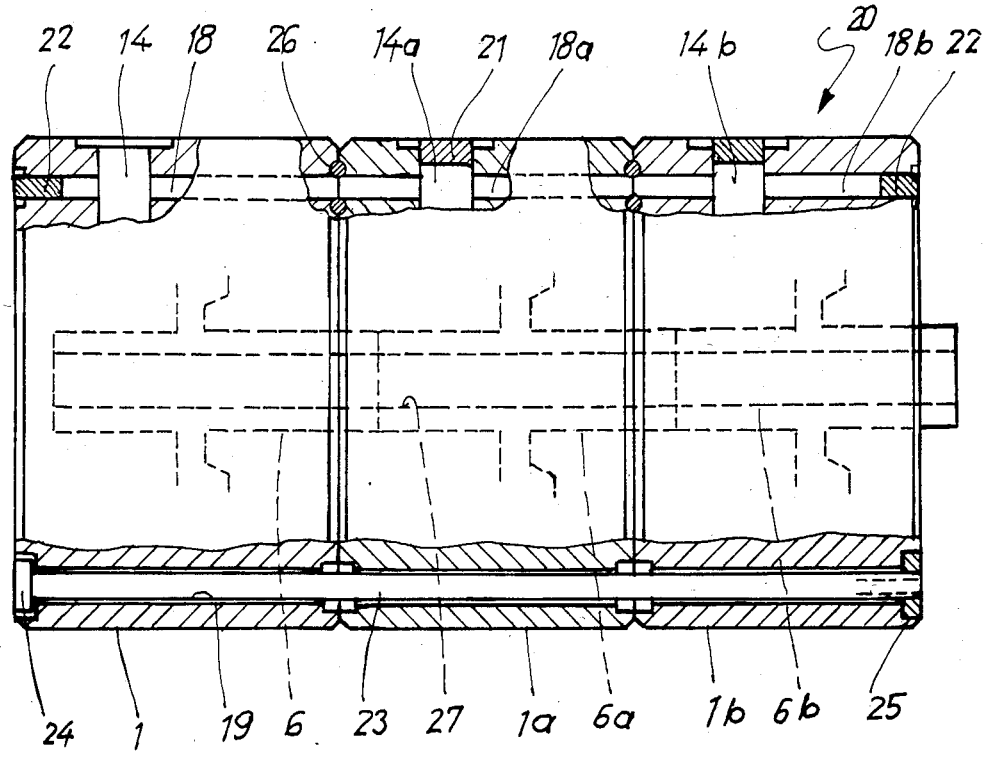
FIG. 2 is a side view and partial section of a piston and cylinder actuator made up of modular cells as in FIG. 1.

Such an assembly 20 will be seen in FIG. 2. It is composed of a plurality of cells as in FIG. 1 placed together to form an axial sequence from end to end. The cells may be detached from each other if desired. In the present working example it is a question of three cells 1, 1*a* and 1*b*. The design is in this respect such that when the cells are put together the end faces of the respective piston rods 6, 6*a* and 6*b* of adjacent cells abut each other. The points of abutment between two respectively adjacent piston rods and the outline of the piston rods themselves are marked in chained lines in FIG. 2. Furthermore in this multiple arrangement the piston driving spaces 13 on the same side of each piston are supplied with driving fluid in parallel, something made possible using but one connection duct together with the separate connection holes 18, 18*a* and 18*b*, only the connection hole of one of the single cells being connected with an open port to the exterior.

In the working example it is only the exterior connection hole 14 of the cell 1 on the left that is open to the outside. The exterior connections of the other separate cells 6*a* and 6*b* are sealed off, for example using a plug 21, only illustrated diagrammatically, fitted into each of the connection holes 14 and 14*b*, for example by being screwed in place to make a tight joint. If driving fluid is supplied to the connection hole 14, such fluid will flow not only into the piston driving space 13 of the respective separate cell 1, but also into the connection duct or hole 18 branching off therefrom which at the end opposite to the adjacent cell 1*a* is sealed off from the outside by the plug 22. Since the connection holes 18, 18*a* and 18*b* in the assembled condition open at the adjacent end faces of the separate cells at the same position on each cell so that the connection holes are lined up with each other in the multiple arrangement of FIG. 2, the driving fluid flows out of the connection hole 18 into the connection holes 18*a* and 18*b* of the other cells and thence via the connection holes 14*a* and 14*b* (sealed off from the outside) into the piston driving spaces of such cells so that all the pistons are acted upon by the driving fluid simultaneously. It will be clear that the port, turned away from the connection hole 18*a*, will be stoppered, as for example by a similar plug 22. The simultaneous venting of all the piston driving spaces takes place in the same way in the reverse direction.

It will furthermore be clear that the duct system noted may be modified. The radial through hole 14 and the axial connection hole 18 intersecting same are however particularly convenient from the manufacturing aspect.

Because of the abutment of the piston rods against each other the piston force of each respective cell will be transmitted to the piston rod of the cell coming after it in the direction of the force so that, considered as an entity, the piston forces of all the separate cells are summated as an overall force, that takes effect at the force output end of the actuator. FIG. 2 shows the arrangement when the pistons are being driven, that it to say, when the compound or segmented piston rod made up of the separate piston rods 6, 6*a* and 6*b* is displaced in the direction of piston rod action. On the other hand FIG. 1 illustrates the condition in which the piston is at rest with the piston rod 6 at the end of the return stroke in its initial position.

Without abandoning the principle of segmented actuators made up of individual units specially adapted to be coupled together modularly, but which may be used separately if required, it would also be feasible to construct kits with different individual units, and for example the individual unit which forms the end opposite to the piston rod end of the assembled actuator, might be made with a solid, i.e. hole-free end wall and without one piston rod part. Furthermore the cell or unit at the force output or piston rod end of the assembled actuator might be made with a piston rod so long as to always project from the actuator. Since the assembled actuator only has to have one single exterior connection or port, the cells might be made with and without such ports for exterior connection so that the plugs 21 would be dispensed with (although naturally the respective connection hole of such cells would have to be connected with the respective piston driving space). Lastly cells forming the ends of the assembled actuator might have their connection holes ending internally (the plugs 22 then being unnecessary).

However it is preferred for all the cells, as illustrated, to be identical in their structure to keep down production and stockholding costs and make the system as universal in application as possible. Furthermore it is best for the cells to have the same form and size.

It is furthermore preferred for the piston rod of at least every middle cell to be of the same length as the cylinder of the cell. In the working example the piston rods of all individual cells have this length, it furthermore being clear from FIG. 1 that in the resting condition the two end faces of the piston rod 6 are best aligned with the respective adjacent plane of the end of the cylinder.

The individual cells are attached together with the aid of axial mounting holes 19, that in the assembled condition are aligned with each other so that there are holes running from end to end of the set of cells, such holes being distributed around the circumference of the actuator. Connection bolts 23 may be placed in the holes to run from end to end of the actuator to the other. In the working example the illustrated connection bolt 23 has a head 24 which may for example have an allen key socket therein, while on the other end there is a nut 25 to clamp the individual cells together. Since each mounting hole 19 is counterbored at its ends, the bolt head 24 and the bolt nut 25 are sunk.

It will furthermore be gathered from FIG. 2 that in the assembled condition there is a packing 26 placed between the joins in the aligned connection holes 18, 18*a* and 18*b*. In the present working example this packing is in the form of an o-ring, that is seated in each counterbored end adjacent to the next connection hole.

It is furthermore preferred to make each piston rod 6 of the separate cells hollow (see FIG. 1) so that in the assembled condition there is a continuous bore 27 through the compound piston rod running between, and opening at, the two opposite ends of the actuator. This makes it possible for a vacuum driven gripping device to be mounted at the output end of the actuator and to be connected via the bore 27 with a vacuum supply at the opposite end of the actuator.

A simple way of connecting the piston rod with any desired fittings is for the hollow piston rod 6 to be tapped.

From the aspect of production technique and costs it is more specially preferred for the cylinder 4 of each individual cell to have a single-piece cylinder pot, preferably of synthetic resin, whose floor forms one of the end walls of the cylinder. In the case of single acting pistons (FIG. 1) the piston driving space 13 into which the driving fluid is admitted is best on the pot floor side of the piston, i.e. on the side of the end wall 2. In this case it is not only unnecessary for the end wall 2 to be separately assembled on the cylinder 4 but furthermore for there to be any packing therebetween.

The pot floor, viz., the end wall 2, furthermore has a central collar 28 projecting towards the piston 5 and encircling the piston rod part 7. Such projecting collar may for example be conical in form and act as a stop for the piston 5. There is an annular space 29 around the projection through which driving fluid is supplied and let off, that is to say, the connection hole 14 opens into the annular space 29 and therefore into the piston driving space 13, the facing side of the piston always being exposed.

In the case of FIG. 1 the cylinder end wall 3 at the end opposite to the pot floor, is formed by a cylinder cover that is seated in a widened part 30 of the bore of the cylinder and is also preferably made of resin. This cover is locked in place axially by circlip 31 sunk in an annular groove in said widened part 30.

It is furthermore preferred for the piston 5 and the piston rod 6 to be made of resin in one piece.

The principle of individual cells able to be coupled together may also readily realized in the case of an actuator with double acting piston means. A single cell 1' suitable for this purpose will be seen in FIG. 3. A compound actuator made up of such cells is characterized in that there is a single connection hole for the supply of fluid under pressure in parallel to all second piston driving spaces 40. That is to say, all the individual cells 1' have a connection hole 41 in the wall of the respective cylinder 4', such hole running axially and joining with the second piston driving space 40 of the respective cell 1'. The second connection hole 41 of one of the separate cells 1' is connected with an open second port for the second connection line. And the second connection holes 41 of all individual cells end at the end faces, which in the assembled condition are fitted together, at aligned positions. In this respect in the case of the embodiment of FIG. 3 the open second exterior connection or port is formed by a second connection hole 42. If all the individual cells have an axial end-to-end second connection hole and a second exterior port, then it is possible in this case as well as for the ports of the connection holes and the exterior ports to be sealed off, as for example using a plug. In other words it is a question here of a construction that is identical to the first embodiment herein with the exception of the fact that the return stroke is not caused by a return spring 16 but by the supply of fluid under pressure to the second piston driving space 40. The supply of fluid to all the second piston driving spaces 40 takes place in the same way as the supply to the first piston driving spaces 13 so that no repetition of the description in this respect is necessary.

Figure 3:
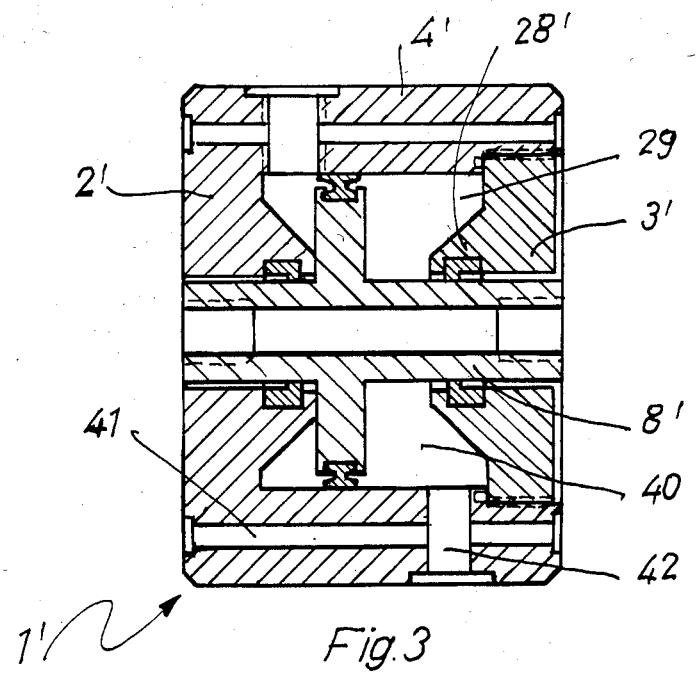
FIG. 3 is a view of a further possible form of a modular cell.

It will be clear that in the case of FIG. 3 as well there are mounting holes corresponding to the mounting holes 19. Such holes are however not in the plane of FIG. 3.

It naturally follows that in the case of the double acting individual cell 1' it is necessary to have a packing between the end wall 3' and the cylinder 4' and between the wall 3' and the piston rod part 8'. To this end the cylinder cover forming this end wall 3' is screwed sealingly into the cylinder 4' in this form of the invention. Moreover, this end wall 3' has a form that is symmetrical with respect to the end wall 2', viz., there is a again a central annular collar 28' surrounded by a ring-like space 29 with the second connection hole 42 opening into it. With respect to the use of the unit it is more specially to be pointed out as an advantage thereof that as a consequence of the piston rod being made up of separate segments the piston rod may be used both for a thrust and also for a pulling effect, this being significant in applications in which the stroke and the overall length are short for use in holding workpieces.

I claim:

1. A piston and cylinder actuator comprising:

a cylinder means which is closed at one end, a piston means able to be acted upon by driving fluid in at least one axial direction for causing axial reciprocating motion of the piston, a fluid connection for supply of fluid to act on said piston means in said direction, a central piston rod means adapted to protrude from said cylinder means, when said piston is moved by said fluid in a working stroke, said actuator being made up of individual modular cells connected in line axially, each such cell having a cylinder with two, mutually opposite end walls, a piston and a piston rod extending from both sides of said piston, said cylinder end walls each having a central hole in which two ends of said piston rod are slidingly mounted, and in the case of any two such cells placed adjacently to each other the piston rods thereof abut each other, said cylinders each having a cylindrical wall with an axial hole therein, the axial holes of said cells being aligned in the axially assembled condition of the cells to form a single duct running the length of the actuator, one of said cells having a inlet port for connection of said axial hole thereof with an exterior connection, each cell having a port forming a connection between the axial hole thereof with a piston driving space on one side of the piston of the cell, said axial holes of said cells opening at ends thereof at the same positions for connection of the axial holes together in the assembled condition of the cell with end faces of the cells adjoining each other.

2. The actuator as claimed in claim 1 wherein two of such cells are placed at ends of said actuator and further such cells are placed therebetween, at least such further cells having piston rods with a length equal to the cylindrical cell walls thereof.

3. The actuator as claimed in claim 1 wherein said cells are double acting and have second connection holes in the cylindrical walls thereof, such second connection holes being joined together as a single second duct running the length of the actuator for supplying second piston driving spaces in said cells with fluid under pressure in parallel from a single connection line, the second axial holes of said cells being aligned in the axially assembled condition of the cells to form a single duct running the length of the actuator, one of said cells having a port for connection of said second axial hole thereof with an exterior connection, each cell having a port forming a connection between the second axial hole thereof with the said second piston driving space of the cell, said second axial holes of said cells opening at ends thereof at the same positions for connection of the second axial holes together in the assembled condition of the cell with end faces of the cells adjoining each other.

4. The actuator as claimed in claim 1 wherein in each cell said connection hole in said cylindrical wall thereof has such an inlet port, said actuator having means for sealing off all said ports except for at least one port required for supply of driving fluid to said actuator.

5. The actuator as claimed in claim 1 comprising packing between said cells to form a seal between each cell and at least one cell next thereto so that said connection holes are joined together as at least one through duct running from one end of the actuator to the other.

6. The actuator as claimed in claim 1 comprising axial clamping screws running from end to end thereof through axial screw receiving holes in said cylinder walls, said screws being distributed about said piston rod means at spaced positions within the cylindrical walls.

7. The actuator as claimed in claim 1 comprising a return spring located in each cell on a side of said piston therein opposite to said piston driving space, one end of said spring abutting one side of said piston and a further end abutting one of said end walls.

8. The actuator as claimed in claim 1 wherein the piston and piston rod of each such cell are integrally made of resin.

9. The actuator as claimed in claim 1 adapted for pneumatic operation.

10. The actuator as claimed in claim 1 comprising such a cell at one end thereof whose piston rod is covered over at one end thereof.

11. The actuator as claimed in claim 1 wherein said cells are identical in design.

12. The actuator as claimed in claim 11 wherein all said cells are the same in size.

13. The actuator as claimed in claim 1 wherein the piston rod of each cell is hollow from end to end so that said piston rod means of said actuator is hollow.

14. The actuator as claimed in claim 13 wherein ends of said piston rod means are tapped.

15. The actuator as claimed in claim 1 wherein the cylindrical wall of each cell is formed with an integral floor forming one of said end walls of said cell.

16. The actuator as claimed in claim 15 wherein said cells are single acting and in each thereof a piston driving space is defined between said piston of said cell and said integral floor.

17. The actuator as claimed in claim 16 wherein said floor is formed with a collar projecting towards said piston in said piston driving space and forming an abutment for said piston, there being a port for the supply and removal of fluid to and from an annular space around said collar.

18. The actuator as claimed in claim 15 wherein the cylindrical wall of each cell with its integral floor is formed of synthetic resin.

19. The actuator as claimed in claim 18 wherein as and end wall each cell comprises a cylinder cover placed opposite to said floor and locked in a widened part of a bore of said cylindrical wall by a circlip fitting in an internal annular groove in said widened part.

20. The actuator as claimed in claim 19 wherein said cover is formed of synthetic resin.

* * * * *